US010094062B2

(12) United States Patent
Erickson et al.

(10) Patent No.: US 10,094,062 B2
(45) **Date of Patent: *Oct. 9, 2018**

(54) LAUNDRY TREATING APPLIANCE WITH SUSPENSION AND SEAL

(71) Applicant: WHIRLPOOL CORPORATION, Benton Harbor, MI (US)

(72) Inventors: Donald E. Erickson, Stevensville, MI (US); George W. Malheiros, Saint Joseph, MI (US); Christoph J. Miller, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 467 days.

This patent is subject to a terminal disclaimer.

(21) Appl. No.: 14/810,851

(22) Filed: Jul. 28, 2015

(65) Prior Publication Data

US 2016/0177486 A1 Jun. 23, 2016

Related U.S. Application Data

(63) Continuation-in-part of application No. 14/574,522, filed on Dec. 18, 2014, now Pat. No. 9,765,467.

(51) Int. Cl.

| | |
|---|---|
| ***D06F 37/22*** | (2006.01) |
| *D06F 37/26* | (2006.01) |
| *D06F 37/20* | (2006.01) |

(52) U.S. Cl.

CPC ..... *D06F 37/22* (2013.01); *D06F 37/206* (2013.01); *D06F 37/265* (2013.01); *D06F 37/267* (2013.01); *D06F 37/268* (2013.01)

(58) Field of Classification Search

CPC ..... D06F 37/22; D06F 37/205; D06F 37/265; D06F 37/267; D06F 37/268; D06F 37/269

See application file for complete search history.

(56) References Cited

U.S. PATENT DOCUMENTS 2,610,523 A * 9/1952 Kahn ..... D06F 37/225 210/144

2,737,040 A 3/1956 Anderson (Continued)

FOREIGN PATENT DOCUMENTS

| | | | |
|---|---|---|---|
| DE | 102007026130 | A1 | 12/2007 |
| GB | 595769 | A | 12/1947 |
| GB | 625326 | A | 6/1949 |

OTHER PUBLICATIONS

German Search Report for Counterpart DE102015117160.0, dated Jul. 19, 2016.

*Primary Examiner* — Joseph L. Perrin
*Assistant Examiner* — Irina Graf

(57) ABSTRACT

A laundry treating appliance comprising a chassis defining an interior with at fixed tub disposed in the interior, the tub defining a liquid chamber. An exoskeleton is disposed within the liquid chamber and houses a drum defining a treating chamber for treating laundry. A suspension comprising one or more suspension component mounts the exoskeleton to that chassis through an opening in the tub. The interior is sealed from the liquid chamber by a plurality of seals at the openings and suspension components extending through the openings, preventing liquid from spilling into the interior from the liquid chamber.

18 Claims, 11 Drawing Sheets

(56) References Cited

U.S. PATENT DOCUMENTS

| | | | | |
|---|---|---|---|---|
| 3,235,082 | A * | 2/1966 | Wilfried | D06F 37/225 210/138 |
| 3,995,458 | A * | 12/1976 | Grunewald | D06F 31/005 68/140 |
| 5,913,951 | A * | 6/1999 | Herr | D06F 37/225 68/23.2 |
| 2004/0244121 | A1* | 12/2004 | Lim | D06F 23/06 8/159 |
| 2006/0254321 | A1* | 11/2006 | Lim | D06F 37/225 68/12.01 |
| 2011/0296877 | A1* | 12/2011 | Song | D06F 37/20 68/139 |
| 2012/0006070 | A1* | 1/2012 | Song | D06F 37/04 68/140 |
| 2012/0018996 | A1* | 1/2012 | Stempfle | A47L 15/4219 285/141.1 |
| 2012/0144598 | A1* | 6/2012 | Ostdiek | D06F 37/06 8/137 |
| 2013/0031938 | A1 | 2/2013 | Cho et al. | |
| 2013/0036776 | A1 | 2/2013 | Seo et al. | |
| 2014/0190219 | A1* | 7/2014 | Kim | H02K 21/12 68/140 |

* cited by examiner

LAUNDRY TREATING APPLIANCE WITH SUSPENSION AND SEAL

CROSS REFERENCE TO RELATED APPLICATIONS

This application is a continuation in part of and claims the benefit of U.S. application Ser. No. 14/574,522 filed Dec. 18, 2014, now U.S. Pat. No. 9,765,467, issued Sep. 19, 2017, which is incorporated herein by reference in its entirety.

BACKGROUND

Laundry treating appliances, such as clothes washers, refreshers, and non-aqueous systems, may have a configuration based on a cabinet within which is housed the components of the appliance, including a tub. The tub may house a rotating drum that defines a treating chamber in which laundry items are placed for treating. The tub is dynamically connected to the suspension system to support the drum. The tub is dimensioned to accommodate tub movement within the cabinet, movement of the drum within the tub, and to support forces generated by the weight and rotation of the drum.

The tub dynamically connects to a suspension system to support the movement of the tub within the cabinet, dampening any movement or vibrational transmission from the tub. Supporting the movement of the tub within the cabinet necessarily limits capacity of the tub, thus limiting the capacity of the drum within the tub and the volume of laundry which can be treated within the treating chamber.

BRIEF SUMMARY

A laundry treating appliance configured to treat laundry according to a cycle of operation, comprising a chassis defining an interior. A tub is located within the interior and is statically mounted to the chassis, the tub further defining a liquid chamber. A rotatable drum is located within the liquid chamber and is rotatable about a horizontal axis. An electric motor, having a drive shaft operably coupled to the rotatable drum, effects rotation of the drum with rotation of the drive shaft. An exoskeleton located within the liquid chamber has a rear support directly supporting at least one of the rotatable drum and the electric motor. A suspension, comprising at least one suspension component, couples to the exoskeleton and extends through an opening in the tub, permitting dynamic movement of the exoskeleton. One or more seals, associated with each of the at least one suspension components, prevents liquid flow from the liquid chamber to the interior through the opening in the tub.

A laundry treating appliance configured to treat laundry according to a cycle of operation, comprising a chassis defining an interior. A tub located within the interior statically mounts to the chassis, the tub further defining a liquid chamber. The tub further comprises at least one opening fluidly coupling the interior to the liquid chamber. An exoskeleton is located within the liquid chamber and is coupled to the chassis. A suspension comprises at least one suspension component coupling the exoskeleton to the chassis. A seal associated with the at least one suspension components, prevents liquid flow from the liquid chamber to the interior through the opening.

DETAILED DESCRIPTION

Figure 1:
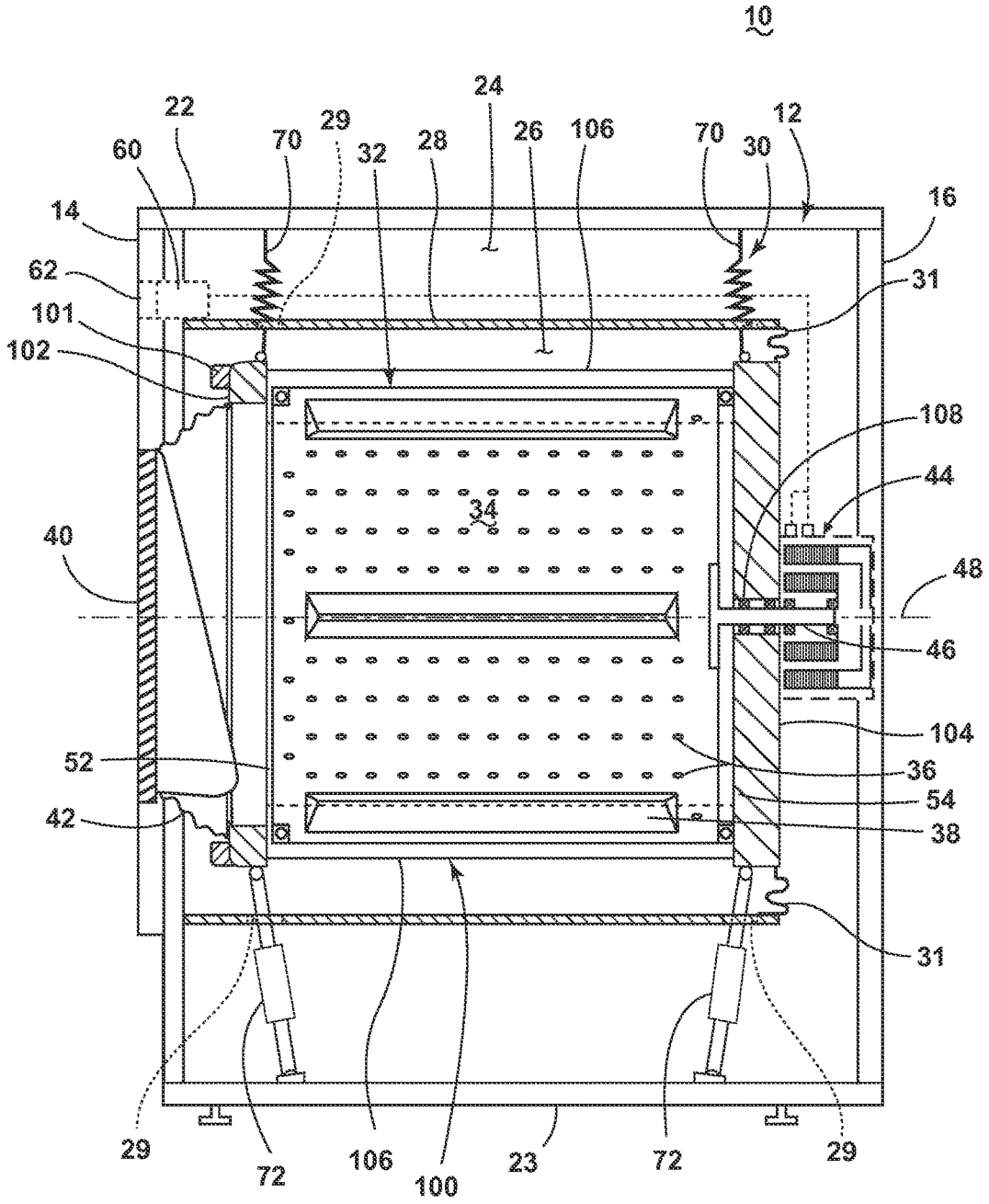
FIG. 1 is a schematic side sectional view of a washing machine according to an embodiment of the invention.

FIG. 1 is a schematic view of a laundry treating appliance according to an embodiment of the invention. The laundry treating appliance may be any appliance which performs a cycle of operation to clean or otherwise treat items placed therein, non-limiting examples of which include a horizontal axis clothes washer; a clothes dryer; a combination washer and dryer; a tumbling or stationary refreshing/revitalizing machine; an extractor; a non-aqueous washing apparatus; and a revitalizing machine. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes.

Figure 2:
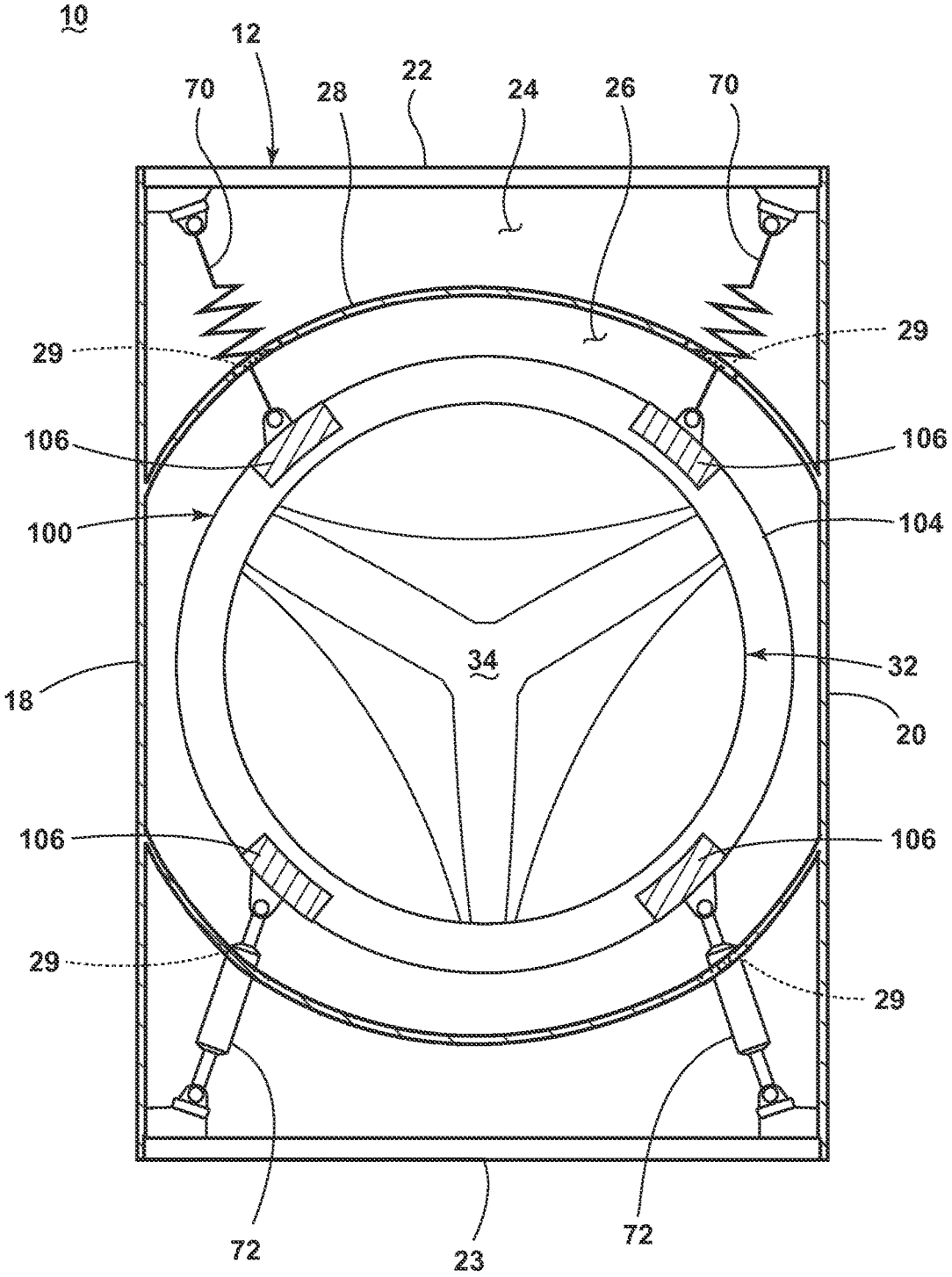
FIG. 2 is a schematic front sectional view of a washing machine according to an embodiment of the invention.

As may best be seen in FIGS. 1 and 2, the laundry treating appliance is illustrated as a washing machine 10, which may include a structural support system comprising a chassis 12 in the form of a frame which may be used to support additional components of the washing machine 10. For example, the chassis 12 may be coupled or integrally formed with panels comprising a front wall 14, a rear wall 16, opposing side walls 18 and 20, an upper wall 22, and a bottom wall 23, which together may form a cabinet enclosing the internal components of the washing machine 10. The panel walls 14, 16, 18, 20, 22, and 23 may be coupled with the chassis 12 using any suitable mechanical or non-mechanical fastener or combination of fasteners, non-limiting examples of which include bolts, screws, snap-fit fasteners, clips, clamps, adhesives, or welds. If the washing machine 10 is a built-in appliance such that one or more sides of the washing machine 10 are encompassed by cabinetry, walls, paneling or furniture at the installation site, one or more of the walls 14, 16, 18, 20, 22, and 23 may not be included. The chassis 12, and optionally the panel walls 14, 16, 18, 20, 22, and 23 may define an interior 24 enclosing components typically found in a conventional washing machine, such as motors, pumps, fluid lines, controls, sensors, transducers, and the like. Such components will not be described further herein except as necessary for a complete understanding of the invention.

A liquid chamber 26 is defined by a tub 28, which is supported by the chassis. The tub 28 is statically mounted to the chassis 12. Alternatively, the tub 28 may be at least partially mounted to the front wall 14 and the opposing side walls 18 and 20. The tub 28 may also be integrally formed with the opposing side walls 18 and 20 as seen in FIG. 2. By statically mounted, it is meant that the tub 28 is not coupled by a suspension system to the chassis. The tub 28 is, thus, statically located relative to the chassis. Such a mount configuration provides for the tub 28 to be mounted directly to the chassis and/or the walls. In addition, portions of the chassis and walls can function as part of the tub 28.

A laundry holding assembly is disposed at least partially within the liquid chamber 26 and is defined by an exoskeleton 100, a drum 32 provided within the exoskeleton 100, and a laundry treating chamber 34 at least partially defined by the drum 32. The exoskeleton 100 physically supports the drum 32 and a suspension system 30 extends between the exoskeleton 100 and the chassis 12 to provide suspension directly to the exoskeleton 100. In turn, the suspension system 30 indirectly provides suspension for the drum 32. The suspension system 30 is configured to reduce the movement and vibration of the laundry holding assembly during a cycle of operation.

The drum 32 may include a plurality of perforations 36 such that liquid may flow between the tub 28 and the drum 32 through the perforations 36. A plurality of baffles 38 may be disposed on an inner surface of the drum 32 to lift the laundry load received in the treating chamber 34 while the drum 32 rotates.

The laundry holding assembly may further include a door 40 which may be movably mounted to the chassis 12 to selectively close the drum 32. A bellows 42 may couple a front opening in the exoskeleton 100 with the chassis 12, with the door 40 sealing against the bellows 42 when the door 40 closes the drum 32.

The washing machine 10 also includes a drive system for rotating the drum 32 and may include an electric motor 44 physically supported by the exoskeleton 100, which is directly coupled with the drum 32 through an output shaft or drive shaft 46 to rotate the drum 32 about a longitudinal axis 48 of the drum 32 during a cycle of operation. The electric motor 44 may be a brushless permanent magnet (BPM) motor having a stator and a rotor. Alternately, the electric motor 44 may be coupled to the drum 32 through a belt and a drive shaft to rotate the drum 32, as is known in the art. Other motors, such as an induction motor or a permanent split capacitor (PSC) motor, may also be used. The electric motor 44 may rotate the drum 32 at various speeds in either rotational direction.

The washing machine 10 may include additional features typically found in a conventional washing machine, the details of which are not germane to the present invention. For example, the washing machine 10 may include a liquid supply system for supplying water to the washing machine 10 for use in treating laundry during a cycle of operation and a dispensing system for dispensing treating chemistry to the treating chamber 34 for use in treating the laundry according to a cycle of operation. The washing machine 10 may also include a recirculation and drain system for recirculating liquid within the laundry holding assembly and draining liquid from the washing machine 10. Liquid supplied to the drum 32 or tub 28 enters a space between the tub 28 and the drum 32 and may flow by gravity to a drain conduit, which may drain the liquid from the washing machine 10, or to a recirculation conduit to direct liquid into the drum 32. In this manner, liquid provided to the drum 32 or tub 28, with or without treating chemistry may be recirculated into the treating chamber 34 for treating the laundry within. The liquid supply and/or recirculation and drain system may be provided with a heating system which may include one or more devices for heating laundry and/or liquid supplied to the drum 32 or tub 28, such as a steam generator and/or a sump heater, the details of which are not germane to the present invention. Any suitable liquid supply system, dispensing system, recirculation system and/or drain system may be used with the embodiments of the present invention, the details of which are not germane to the present invention.

The washing machine 10 also includes a control system for controlling the operation of the washing machine 10 to implement one or more cycles of operation. The control system may include a controller 60 located within the chassis 12 and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller 60 is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components. The controller 60 may be provided with a memory for storing control software that is executed by a central processing unit of the controller 60 in completing a cycle of operation using the washing machine 10 and any additional software.

The controller 60 may be operably coupled with one or more components of the washing machine 10 for communicating with and controlling the operation of the component to complete a cycle of operation. For example, the controller 60 may be operably coupled with the electric motor 44 and any other additional components that may be present such as a steam generator, a treating chemistry dispenser, and a sump heater (not shown) to control the operation of these and other components to implement one or more of the cycles of operation. The controller 60 may also be coupled with one or more sensors provided in one or more of the systems of the washing machine 10 to receive input from the sensors, which are known in the art and not shown for simplicity. Non-limiting examples of sensors that may be communicably coupled with the controller 60 include: a treating chamber temperature sensor, a moisture sensor, a weight sensor, a chemical sensor, an optical sensor, a conductivity sensor, a turbidity sensor, a position sensor and a motor torque sensor, which may be used to determine a variety of system, laundry and liquid characteristics, such as laundry load inertia or mass.

Figure 3:
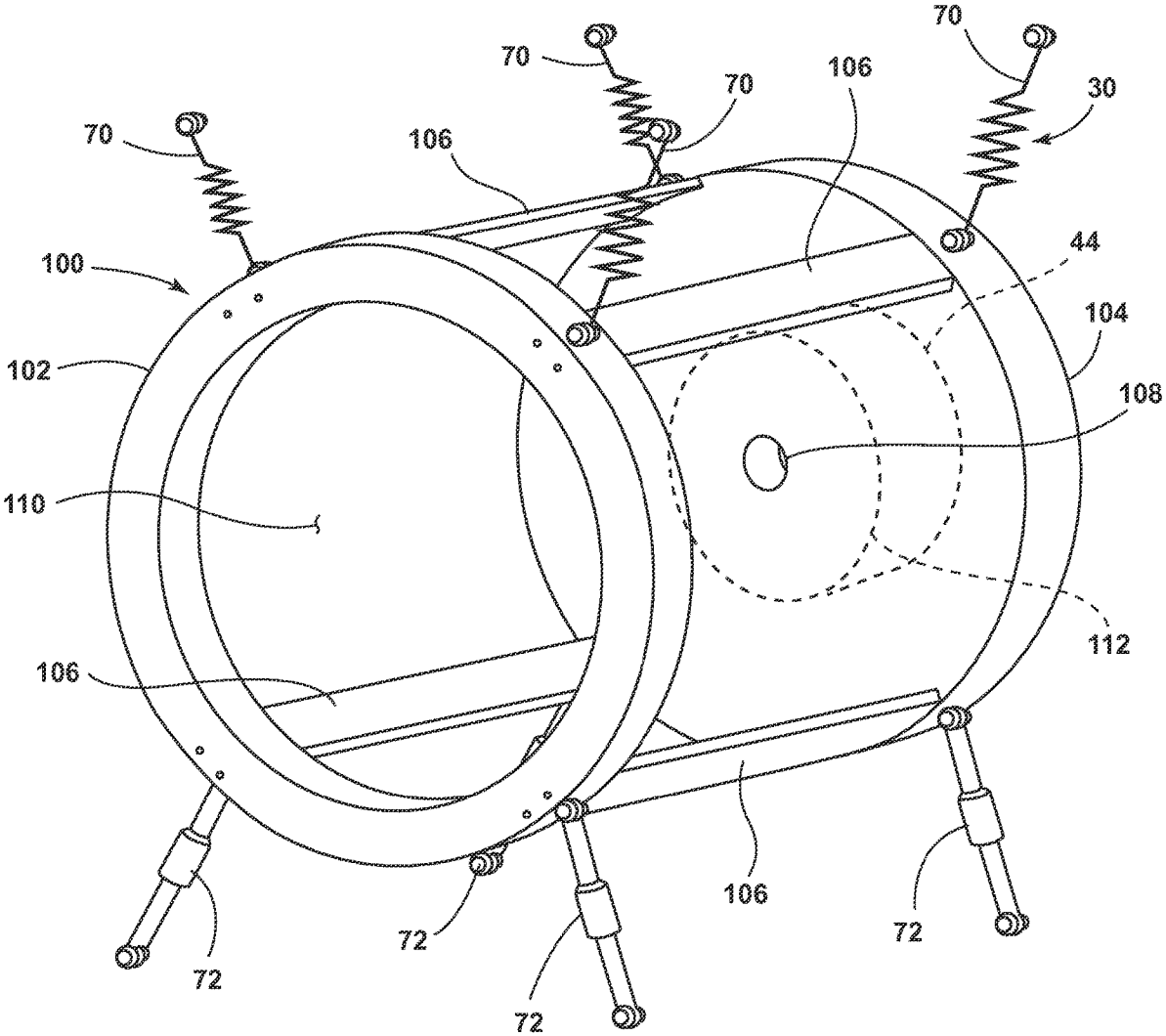
FIG. 3 is a perspective view of a washing machine according to an embodiment of the invention.

FIG. 3 better illustrates the exoskeleton 100 and the suspension system 30 coupled thereto. The exoskeleton 100 comprises a front support 102, a rear support 104, and at least two stringers 106 extending between the front support 102 and rear support 104. The front support 102 forms a substantially annular ring having a central opening 110 to provide access to the drum. The rear support 104 forms a substantially annular disc having a bearing mount 108 defining a shaft passage and a motor mount 112 formed on the rear side of the rear support 104. The stringers 106 comprises an elongated structure that forms a cross support between the front support 102 and rear support 104 to rigidly connect the front support 102 to the rear support 104. The stringers 106 may be attached to the front support 102 and rear support 104 by commonly known fastening devices or fastening methods well known in the art including but not limited to screws, rivets, clamps, and welds. Alternatively, the front support 102, a rear support 104, and stringers 106 may be integrally formed.

The suspension system 30 comprises at least two springs 70 and at least two struts or dampers 72 attached to the front support 102 and rear support 104 of the exoskeleton 100. As illustrated, two springs 70 are attached to the upper portion of both the front support 102 and rear support 104 and two dampers 72 attached to the lower portion of both the front support 102 and rear support 104. Alternatively, the springs 70 and dampers 72 may attach to the stringers 106 or a combination of the front support 102, rear support 104 and stringers 106.

Referring again to FIG. 1, the drum 32 is mounted within the exoskeleton 100 such that the front support 102 is located adjacent a front drum wall 52 and wherein at least a portion of the front support 102 is axially in front of an open front of the drum 32 on the front drum wall 52. The rear support 104 is located adjacent a rear drum wall 54 wherein at least a portion of the rear support 104 is axially behind of the rear drum wall 54. The drum may be rotatably mounted to the rear support 104 through the bearing mount 108. The stringers 106 extend between the front support 102 and rear support 104 and are located around the drum 32, exterior to the treating chamber 34.

The tub 28 at least partially surrounds the exoskeleton 100 and retains liquid within the liquid chamber 26. The tub 28 and front panel wall 14 enclose the front side of the liquid chamber 26. The rear support 104 and a flexible rear seal 31 coupled between a rear portion of the tub 28 and the rear support 104 enclose the rear side of the liquid chamber 26.

The tub 28 also includes a plurality of apertures defining suspension openings 29 between the interior 24 and the liquid chamber 26. The suspension openings 29 are aligned with the suspension system 30 such that the springs 70 and dampers 72 pass through the suspension openings 29 to couple the exoskeleton 100 to the chassis 12.

The electric motor 44 is mounted to the motor mount 112 on the rear side of the rear support 104 such that the electric motor 44 is physically supported by the rear support 104. The drive shaft 46 extends from the electric motor 44 through a bearing assembly mounted in the bearing mount 108 formed in the rear support 104 and is coupled to the rear drum wall 54 of the drum 32. The bearing assembly may comprise a friction reducing surface or friction reducing devices such as roller bearings and is configured to aid in rotation of the drive shaft 46 by reducing friction between the drive shaft 46 and the rear support 104. Alternatively, the at least one counterweight 101 may be coupled to the stringers 106, or a combination of being attached to front support 102 and stringers 106.

The washing machine 10 may also include at least one counterweight 101 provided on the exoskeleton 100. The counterweight 101 may be coupled with the front support 102 or may be integrally formed with the front support 102. The density of the front support 102 may also be configured such that the front support 102 functions as a counterweight 101.

Figure 4:
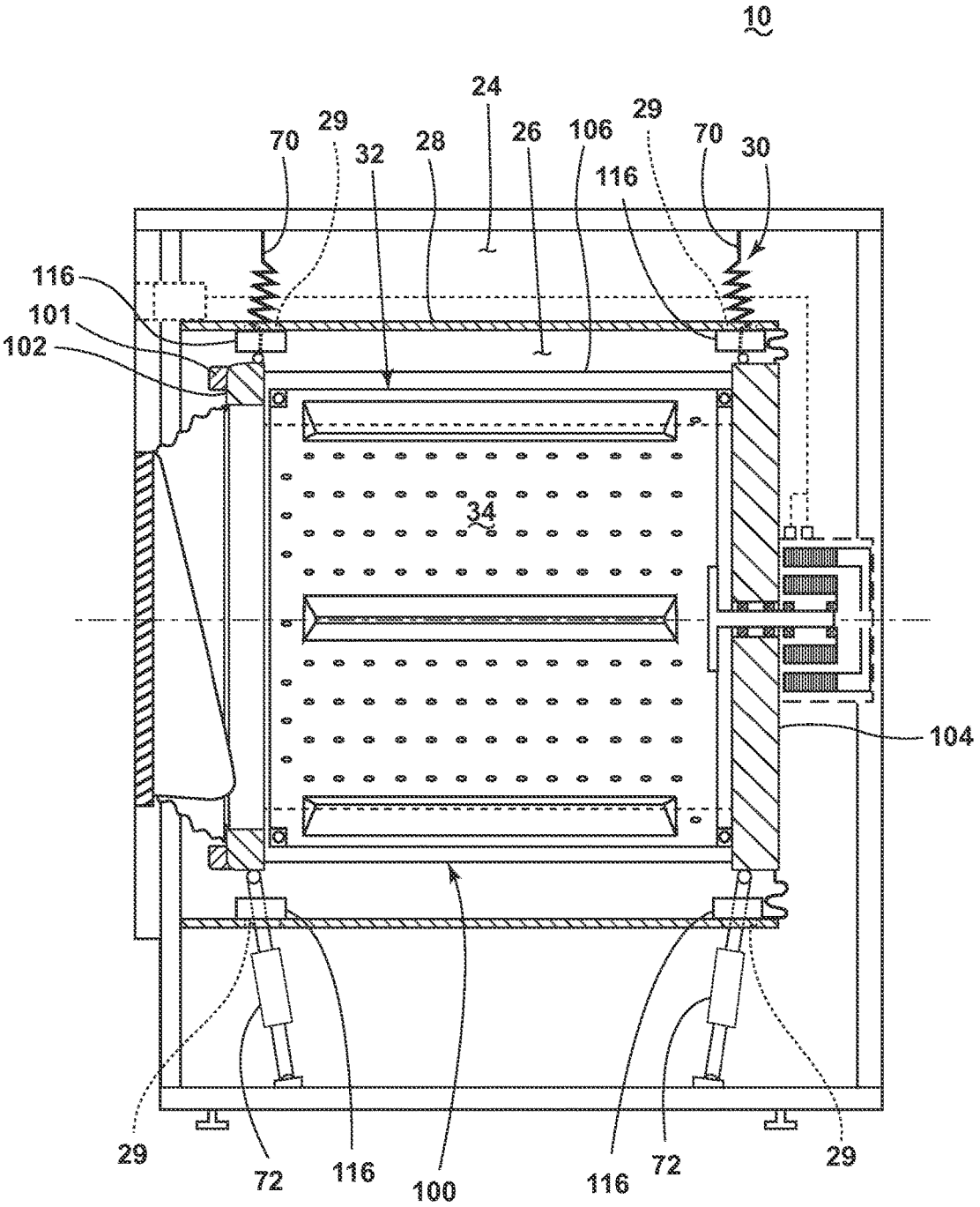
FIG. 4 is a schematic side view of a washing machine according to another embodiment of the invention.
Figure 5:
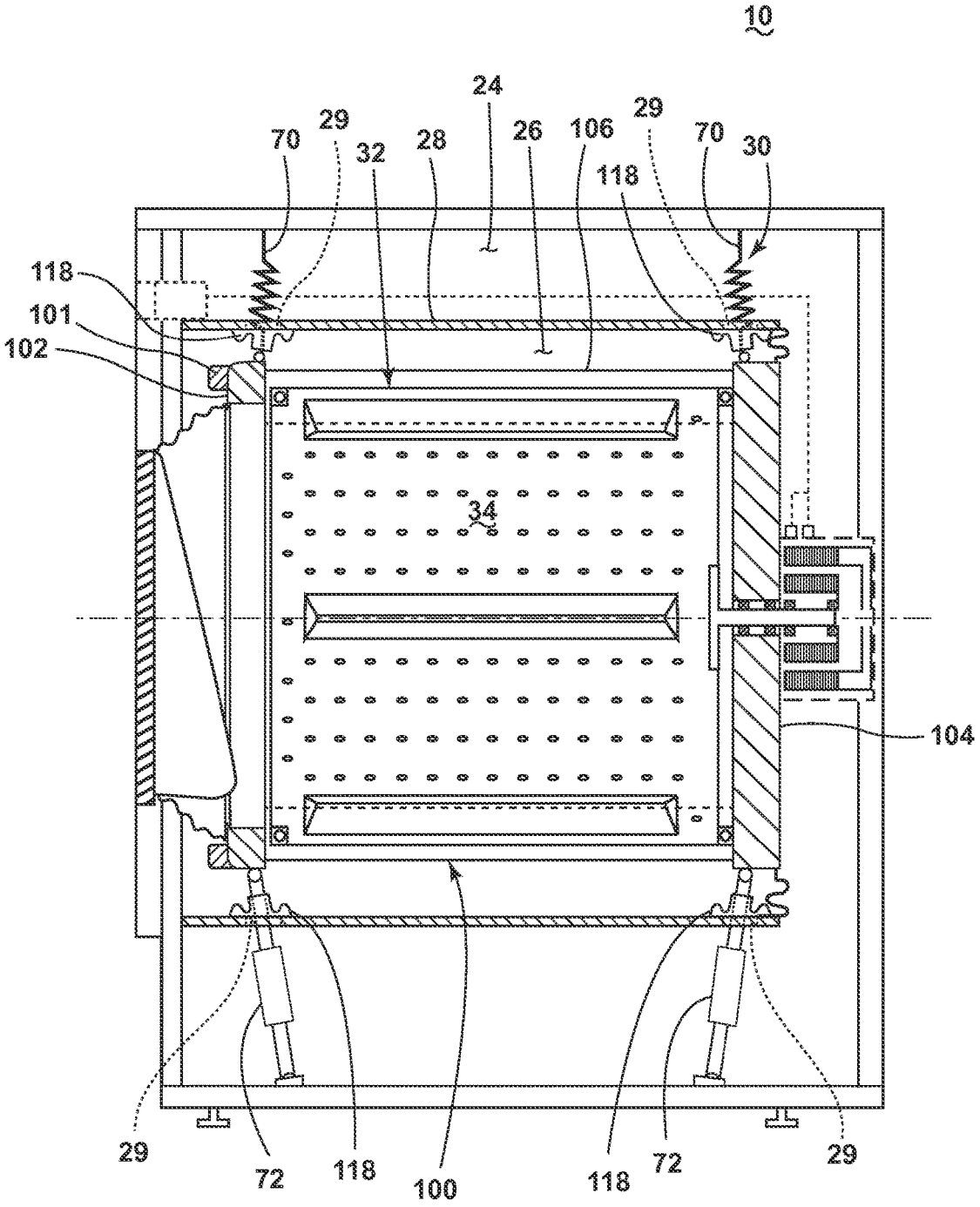
FIG. 5 is a schematic side view of a washing machine according to another embodiment of the invention.

Referring to FIG. 4, the tub 28 may also include a liquid dam, illustrated as raised walls 116, for at least retarding the flow of liquid from the liquid chamber 26 through the suspension openings 29. The raised walls 116 formed on or integrally with the tub 28, extend around the suspension openings 29 and towards the drum 32. In another embodiment shown in FIG. 5, the liquid dam may comprise flexible suspension seals 118 coupled between the suspension system 30 and the suspension openings 29. The flexible suspension seals 118 may be configured to tightly seal around the springs 70 or dampers 72 and the suspension opening 29 while still allowing for movement of the springs 70 or dampers 72.

The washing machine disclosed herein provides a plurality of benefits including that the size of the drum can be maximized to increase washing capacity of the drum without increasing a size of the chassis or cabinet. This is achieved by isolating the tub from the suspension system, supporting the drum with the exoskeleton and allowing the suspension system to extend between the exoskeleton and the chassis through the tub. Isolating the tub from the suspension system eliminates the clearance needed between a moving tub and the chassis. Extending the suspension system through the tub minimizes the space needed between the tub and the chassis to house the suspension system. Supporting the drum generated forces with the exoskeleton allows the tub to function solely as a liquid retainer and not as a structural support for the drum which also allows the tub wall thickness to be reduced. Eliminating clearances needed between the tub and the chassis, minimizing interior space needed to house the suspension system, and reducing the tub wall thickness allow for a larger drum with increase washing capacity without increasing a size of the chassis or cabinet.

Figure 6:
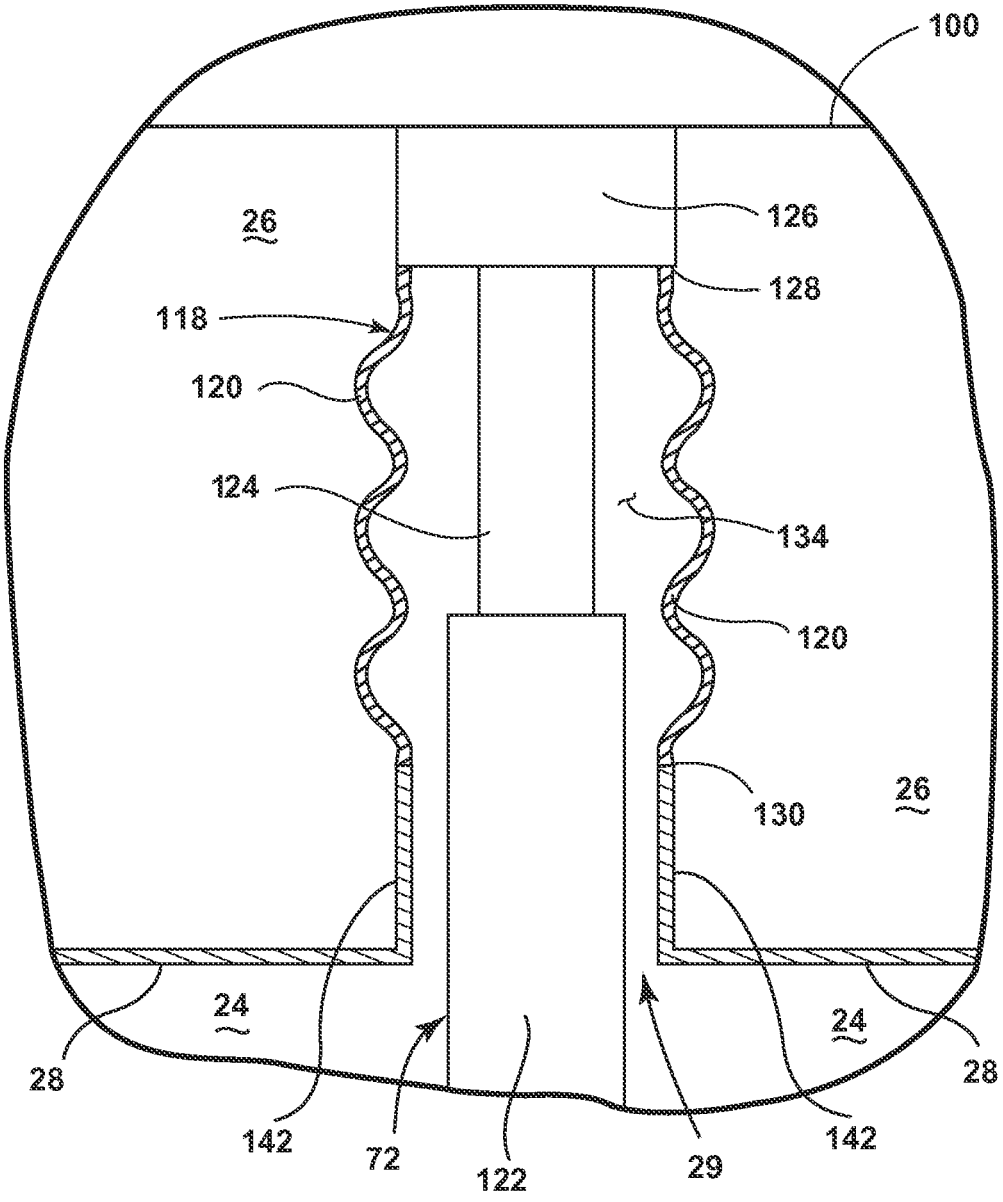
FIG. 6 is a schematic view of one suspension component sealed by a bellows according to a first embodiment of the invention.

Turning now to FIG. 6, a first embodiment of the suspension seals 118 is shown in the form of a bellows 120. The damper 72 is shown comprising a damper body 122 and a damper rod 124, coupling to the exoskeleton 100 at a suspension mount 126. The damper rod 124 can actuate, sliding in and out of the damper body 122 and permitting the dynamic movement of the exoskeleton 100 relative to the tub 28.

The bellows 120 has a somewhat sinusoidal profile common to bellows 120, while any profile shape, such as an "S" shaped bellows 120, is contemplated. The bellows 120 further comprises a bellows top 128, coupled to the suspension mount 126, and a bellows bottom 130, coupled to a wall 142 defining the suspension opening 29. The bellows 120 can mount to suspension mount 126 and the wall 142 by any method known in the industry, such as welding, adhesives, or fasteners. The bellows 120 is generally annular and surrounds the damper 72 to define a bellows space 134 between the bellows 120 and the damper 72, which is in fluid communication with the interior 24. As can be appreciated, any fluid within the liquid chamber 26 can contact the bellows 120, but cannot flow into bellows space 134, preventing any liquid from escaping into the interior 24 from the liquid chamber 26.

Figure 7:
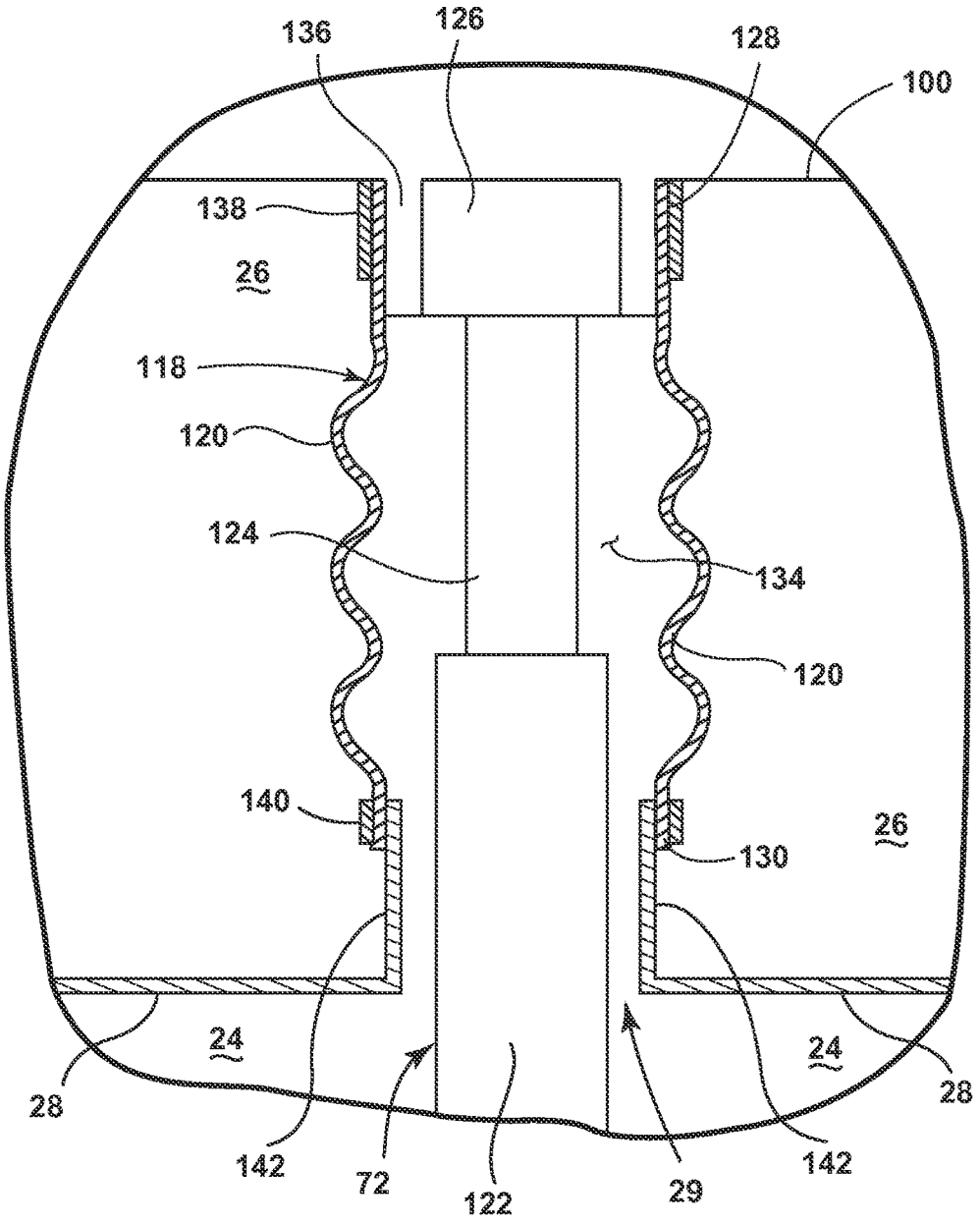
FIG. 7 is a schematic view of the suspension component of FIG. 6 with the bellows sealed by a clamp according to the first embodiment of the invention.

Turning now to FIG. 7, a variation in the exoskeleton 100 can be provided for the bellows 120. In the variation, the exoskeleton 100 can further comprise a seat 136, either mounted to or structurally integral with the exoskeleton 100, adapted to receive suspension mount 126. The bellows top 128 can extend over and surround the seat 136, where an upper clamp 138 can secure the bellows top 128 to the seat 136. Similarly, at the bottom, the bellows bottom 130 can extend over and surround the wall 142 where a lower clamp 140 can secure the bellows bottom 130 to the wall 142. Each clamp 138, 140 secures the bellows 120 tight enough to prevent disconnection of the bellows 120 during movement of the damper 72 and to comprise a water-tight seal between the interior 24 and the liquid chamber 26. In additional embodiments, the bellows 120 can be coupled to the wall 142 and the exoskeleton 100 by an interference fit or a sliding fit.

Figure 8:
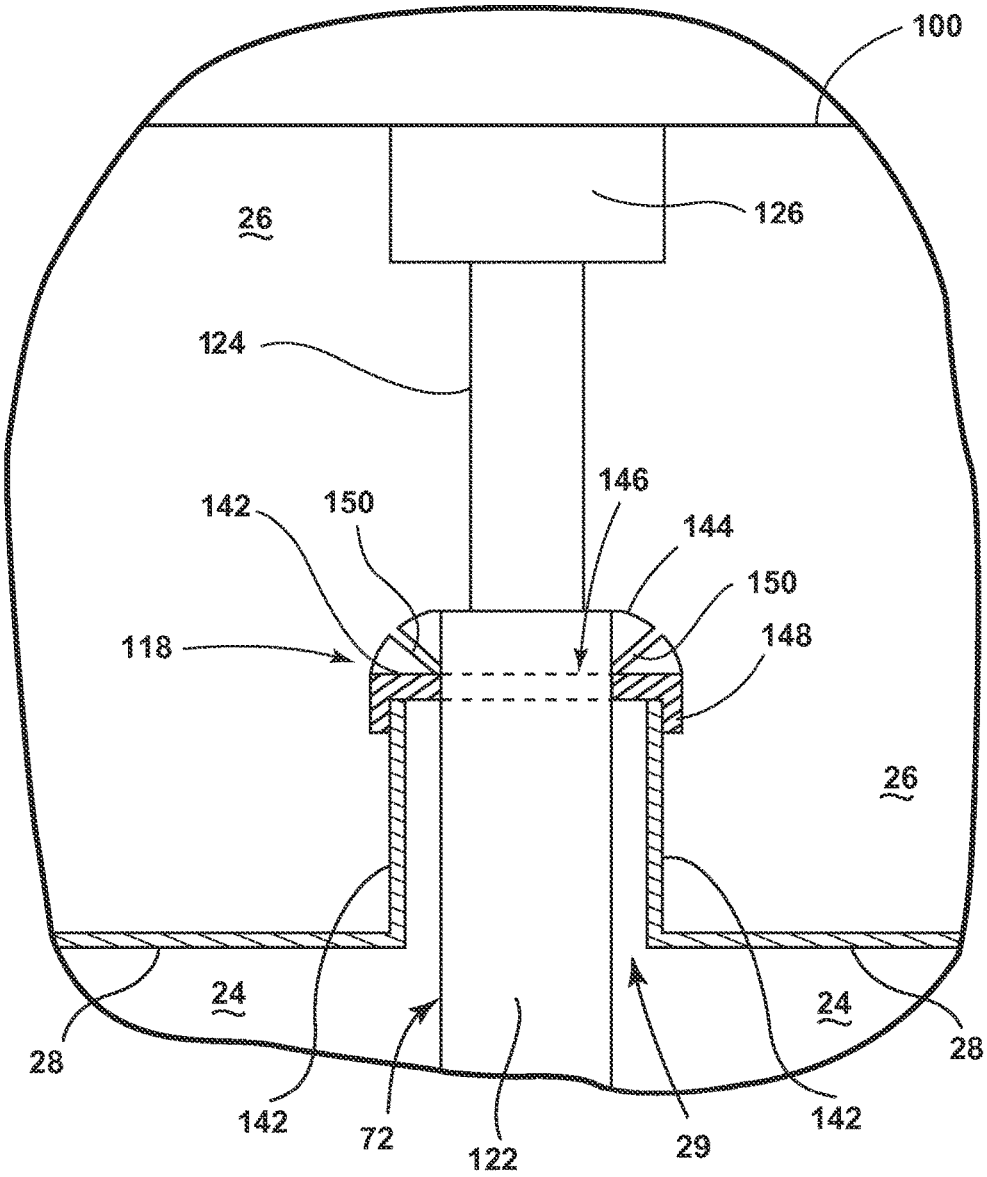
FIG. 8 is a schematic view of the suspension component sealed by a cap according to a second embodiment of the invention.

Turning to FIG. 8, a second embodiment of the suspension seals 118 is shown as a combination wall 142 and cap 144. In this way, the second embodiment is similar to a combination of the raised walls 116 and suspension seals 118 of FIGS. 4 and 5. The wall 142 surrounds the damper 72 and the cap 144 closes the top of the wall 142 and seals it relative to the damper 72. The cap 144 has a through passage 146 through which the damper 72 passes when the cap 144 is mounted to the wall 142. The cap 144 further includes a depending skirt 148 that is sized to surround the top of the wall 142. The skirt 148 may loosely fit about the wall 142 or can press-fit about the wall 142.

The cap 144 is illustrated with a flat surface transitioning to rounded edges. However, any suitable shape is contemplated. The passage 146 can be the same size as the damper 72, or slightly smaller or larger, permitting the sealed insertion of the damper 72. In many instances, the cap 144 need not form a liquid-tight seal relative to the damper 72. In some implementations, it will be sufficient that the cap 144 essentially functions as a splash guard, which would permit a gap between the cap 144 and the damper 72. In other implementations a liquid-tight seal is contemplated. In such cases, the cap 144 would contact the damper 72. The cap 144 can be rubber, malleable plastic, or any other expandable or compressible material such that the cap 144 can expand or compress with the actuation of the damper rod 124, movement of the exoskeleton 100, or movement of the damper 72.

The cap 144 also has a plurality of slits 150 extending from the exterior of the cap 144 to the damper 72. The slits 150 can be shaped as holes, ellipses, or otherwise, in non-limiting examples, and can be disposed in an annular fashion around the entirety of the cap 144. The slits 150 provide a gap in the cap 144 such that flexion of the cap 144 is enhanced during dynamic movement of the damper 72 or the exoskeleton 100. The slits 150 permit the expansion of the cap 144 about the slits 150 or compression of the cap 144 at the slits 150, providing a greater range of flexion of the caps 144 to support the dynamic movements. The increased range of flexion further prevents the suspension seals 118 from tearing or breaking during movement of the dampers 72 or exoskeleton 100. Additionally, the slits 150 can divide the cap 144 into sections where the cap 144 can expand independently of each section, permitting greater movement of the cap 144 in maintaining the seal.

Figure 9:
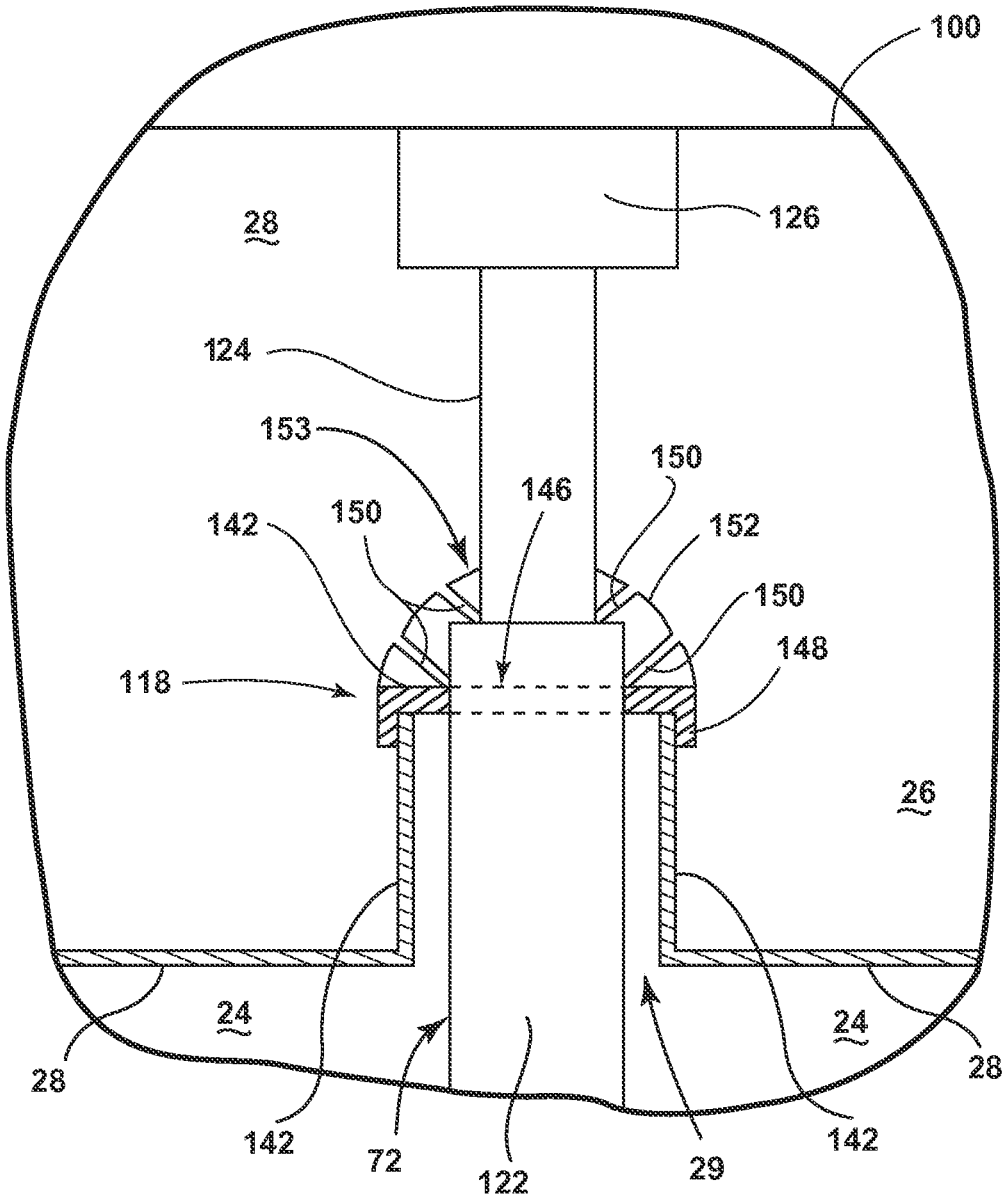
FIG. 9 is a schematic view of the seal of FIG. 8, with the seal having an extended rounded cap according to the second embodiment of the invention.

Turning now to FIG. 9, a variation on the second embodiment cap 144 is shown. An extended cap 152 differs from the cap 144 of FIG. 8, in that it has a rounded top 153 as compared to the flat top of the cap 144 in FIG. 8. The rounded top 153 extends upwardly to surround a portion of the damper rod 124. As with the cap 144 of FIG. 8, the extended cap 152 comprises additional slits 150. The extended cap 152 disposed around the damper rod 124 provides a liquid-tight seal at the damper rod 124 rather than at the damper body 122. The additional slits 150 support the actuation of the damper rod 124 against the cap 144, while maintaining the liquid-tight seal by providing a space in which the cap 144 can expand or compress with the movements of the damper rod 124.

Figure 10:
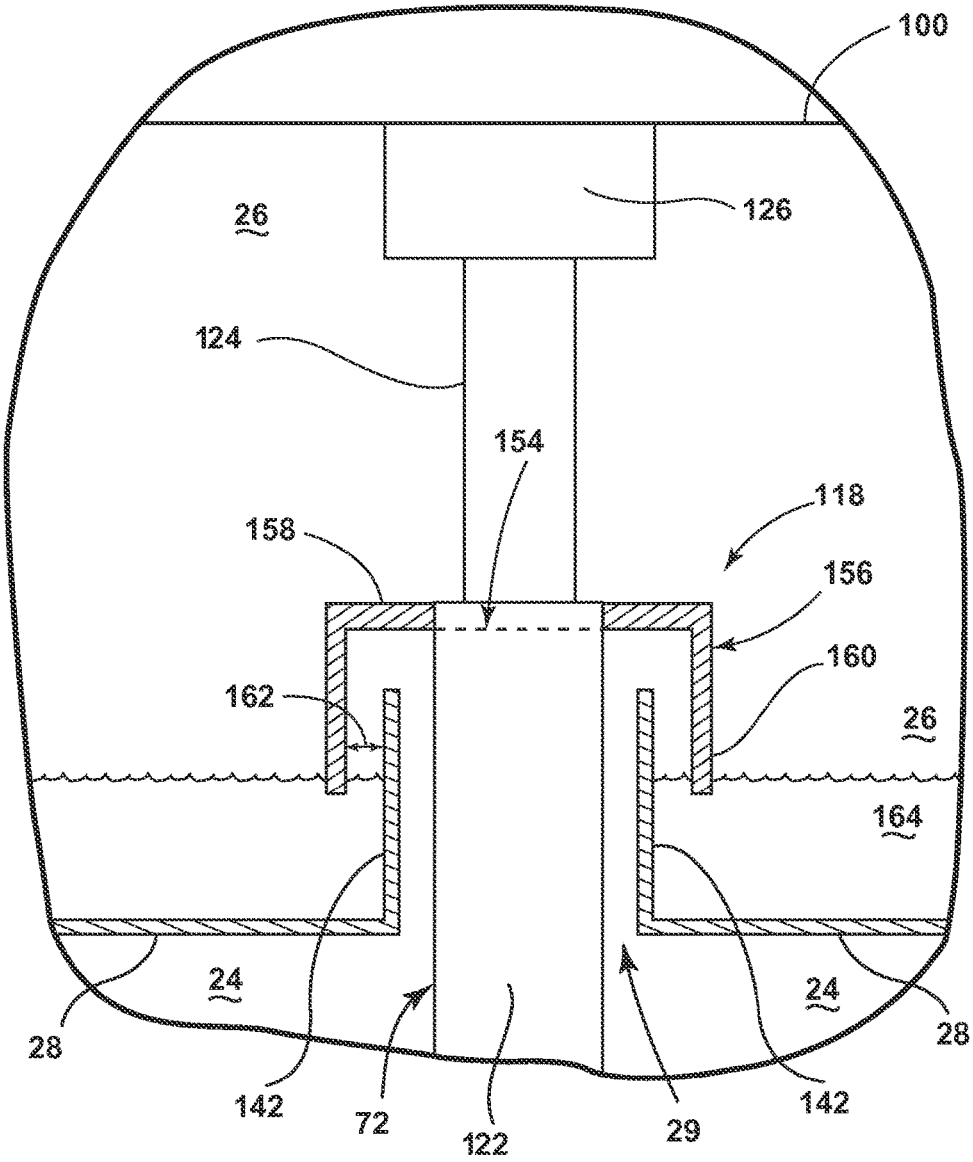
FIG. 10 is a schematic view of the suspension component sealed by an umbrella seal according to a third embodiment of the invention.

Turning now to FIG. 10, a third embodiment of the suspension seal 118 is also a combination of the wall and cap, like the second embodiment, with the cap being an umbrella 156 that overlies the wall 142 to collectively form a labyrinth seal. To space the umbrella 156 from top of the wall 142, the umbrella 156 can comprise an umbrella passage 154 for mounting to the top of the damper 72, or the umbrella 156 can be integrally formed as part of the damper 72. The umbrella 156 is an annular shape, comprising and upside-down "U-shaped" profile. The umbrella 156 can be composed of a flexible polymer or plastic, such as rubber, permitting the umbrella 156 to contact the tub 28 during movement of the exoskeleton 100 without damage to the umbrella 156, the damper 72, the tub 28, or the exoskeleton 100.

The umbrella 156 further comprises an umbrella top 158 disposed at the upper portion of the umbrella 156, the umbrella top 158 coupling to the damper body 122 at the umbrella passage 154. Extending from the umbrella top 158 is an umbrella peripheral wall 160. As shown, the umbrella peripheral wall 160 extends downward at a distance sufficient to surround a portion of the wall 142, while the end of the umbrella peripheral wall 160 remains spaced from the tub 28 at a distance sufficient to permit movement of the exoskeleton 100 or damper 72.

An umbrella gap 162 is defined between the umbrella peripheral wall 160 and the wall 142. As such, the umbrella 156 creates a labyrinth seal between the liquid chamber 26 and the interior 24. The labyrinth seal retards liquid flow and splashing that can occur during movement of the exoskeleton 100 or the damper 72, preventing leakage. Liquid 164 disposed within the liquid chamber 26, can comprise a volume such that the liquid 164 can rise to a level disposed along both the wall 142, the umbrella peripheral wall 160, and within the umbrella gap 162. The umbrella 156 and wall 142 can be sized to anticipate liquid 164 flow into the umbrella gap 162 such that the liquid 164 in the umbrella gap 162 will not rise to a level sufficient to spill over into the interior 24. Furthermore, the umbrella gap 162 can comprise a distance where liquid 164 movement or dynamic movement of the exoskeleton 100 cannot create a wave or splash of liquid 164 sufficient to spill into the interior 24. The gap can be 12 to 20 millimeters (mm) while a gap as great as 30 can be used.

Typical labyrinth seals used in the industry require multiples grooves with associated extensions within the grooves to define a labyrinth path. The umbrella 156 defines a simplified labyrinth without requiring grooves, eliminating the potential for increased machining. Additionally, the vertical orientation of the umbrella 156, which can also be partially submerged in liquid, eliminates issues with escaping water vapor or heat loss typical in common labyrinth seals used in the industry. As such, the umbrella 156 provides increased efficiency in protecting leakage, while reducing costs normally associated with a labyrinth-type seal.

Figure 11:
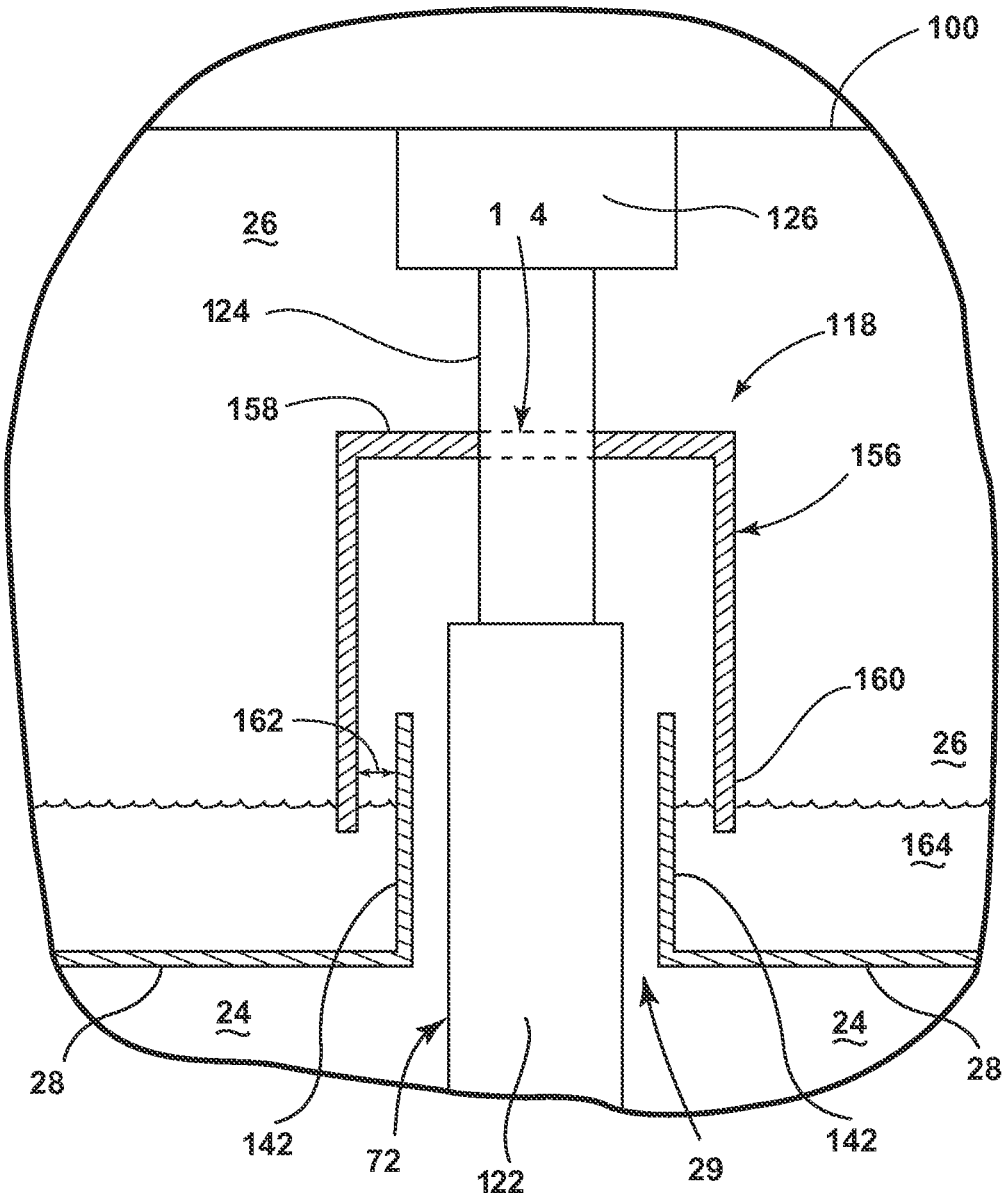
FIG. 11 is a schematic view of the suspension component of FIG. 10, with the umbrella coupling to a damper rod.

Turning now to FIG. 11 a variation on the third embodiment of FIG. 10 is shown. The umbrella 156 now mounts to the damper rod 124 at the umbrella passage 154, such that the umbrella 156 can move in concert with the damper rod 124 during actuation. The umbrella peripheral wall 160 is elongated to remain disposed around the wall 142 at the umbrella gap 162, defining the labyrinth seal between the wall 142 and the umbrella peripheral wall 160. During the downward actuation of the damper rod 124, the umbrella 156 will move downward, preventing the liquid 164 from splashing over the wall 142 caused by the movement of the exoskeleton 100.

While the embodiments disclosed herein describe three different embodiment of seals utilized within a horizontal-axis, laundry treating appliance with a fixed tub, additional seals are contemplated. Non-limiting examples of seals can include adhesives, rings, heat seals, couplings, hermetic seals, gaskets, plugs, etc.

Additionally, while the embodiment described herein have utilized a damper suspension element toward the bottom of the tub, the embodiments can be utilized with springs or any other suspension element, and can be disposed at the top of the tub where heated vapor can commonly escape.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance configured to treat laundry according to a cycle of operation, comprising:

a chassis defining an interior and having a front and a rear;

a tub located within the interior and statically mounted to the chassis with the tub defining a liquid chamber and having a peripheral side wall with at least one opening through the peripheral side wall;

an exoskeleton located within the liquid chamber and having a front support located near the front of the chassis, a rear support located near the rear of the chassis, and stringers extending between and connecting the front and rear supports to collectively form a skeletal frame defining a frame interior;

a rotatable drum supported by the exoskeleton and located within the frame interior and defining a treating chamber;

an electric motor having a drive shaft operably coupled to the rotatable drum, wherein rotation of the drive shaft effects a rotation of the drum;

a suspension system coupling the exoskeleton to the chassis and extending through the at least one opening in the peripheral side wall of the tub; and a seal associated with the suspension system, wherein the seal prevents liquid flow from the liquid chamber to the interior through the at least one opening in the tub.

2. The laundry treating appliance of claim 1 wherein at least a portion of the suspension system is located in the interior.

3. The laundry treating appliance of claim 1 wherein the seal comprises at least one of a bellows, a cap, or an umbrella.

4. The laundry treating appliance of claim 3 wherein the seal includes the bellows having a first end and a second end and surrounding the suspension system and wherein the bellows mounts to the exoskeleton at the first end and to the tub at the second end.

5. The laundry treating appliance of claim 4 further comprising at least one clamp to mount one of the first end of the bellows to the exoskeleton or the second end of the bellows to the tub.

6. The laundry treating appliance of claim 3 wherein the seal includes the cap and the cap overlies the at least one opening in the peripheral side wall.

7. The laundry treating appliance of claim 6 wherein the cap seals the peripheral side wall to the suspension system.

8. The laundry treating appliance of claim 7 wherein at least one slit is provided on the cap.

9. The laundry treating appliance of claim 3 wherein the seal includes the umbrella and defines a labyrinth seal between the interior and the liquid chamber.

10. The laundry treating appliance of claim 1 wherein the suspension system further comprises at least one of a spring, a strut, or a damper.

11. A laundry treating appliance configured to treat laundry according to a cycle of operation, comprising:

a chassis defining an interior and having a front and a rear;

a tub located within the interior and statically mounted to the chassis, with the tub defining a liquid chamber and having a peripheral side wall with at least one opening provided through the peripheral side wall fluidly coupling the interior to the liquid chamber;

an exoskeleton located within the liquid chamber and having a front support located near the front of the chassis, a rear support located near the rear of the chassis, and stringers extending between and connecting the front and rear supports to collectively form a skeletal frame defining a frame interior;

a drum located within the frame interior and coupled to the exoskeleton;

a suspension system coupling the exoskeleton to the chassis and extending through the at least one opening in the tub; and a seal associated with the suspension system, wherein the seal fluidly seals the liquid chamber from the interior at the at least one opening.

12. The laundry treating appliance of claim 11 wherein the seal comprises at least one of a bellows, a cap, or an umbrella.

13. The laundry treating appliance of claim 12 wherein the seal includes the bellows having a first end and a second end and surrounding the suspension system, and wherein the bellows mounts to the exoskeleton at the first end and to the tub at the second end.

14. The laundry treating appliance of claim 13 further comprising at least one clamp to mount one of the first end of the bellows to the exoskeleton or the second end of the bellows to the tub.

15. The laundry treating appliance of claim 12 wherein the seal includes the cap and the cap overlies the at least one opening in the peripheral side wall.

16. The laundry treating appliance of claim 15 wherein the cap seals the peripheral side wall to the suspension system.

17. The laundry treating appliance of claim 16 wherein at least one slit is disposed within the cap.

18. The laundry treating appliance of claim 12 wherein the seal includes the umbrella and defines a labyrinth seal between the interior and the liquid chamber.

* * * * *